US008685211B2

(12) United States Patent
Myakotin et al.

(10) Patent No.: US 8,685,211 B2
(45) Date of Patent: Apr. 1, 2014

(54) OIL SANDS TREATMENT SYSTEM AND PROCESS

(75) Inventors: Igor Myakotin, Moscow (RU); Sergey Rakhinskiy, Thornhill (CA); Lazarus Saidakovsky, Thornhill (CA); Vadim Donchenko, Moscow (RU)

(73) Assignee: Envirotech Green Inc, Toronto, Ontario (CA)

( * ) Notice: Subject to any disclaimer, the term of this patent is extended or adjusted under 35 U.S.C. 154(b) by 172 days.

(21) Appl. No.: 13/374,890

(22) Filed: Jan. 23, 2012

(65) Prior Publication Data

US 2012/0138421 A1 Jun. 7, 2012

Related U.S. Application Data

(62) Division of application No. 12/460,798, filed on Jul. 27, 2009, now Pat. No. 8,192,615.

(51) Int. Cl.

| | |
|---|---|
| ***C10C 1/18*** | (2006.01) |
| ***C10G 21/00*** | (2006.01) |
| ***C10G 1/04*** | (2006.01) |

(52) U.S. Cl.
USPC ..... 196/14.52; 422/127; 422/128; 208/390; 208/391; 208/425

(58) Field of Classification Search
USPC ..... 196/14.52; 422/127, 128; 208/390, 391, 208/425
See application file for complete search history.

(56) References Cited

U.S. PATENT DOCUMENTS

| | | | | |
|---|---|---|---|---|
| 4,054,505 | A * | 10/1977 | Hart et al. | 208/390 |
| 4,151,067 | A * | 4/1979 | Grow | 208/402 |
| 4,443,322 | A * | 4/1984 | Jubenville | 208/391 |
| 4,891,131 | A * | 1/1990 | Sadeghi et al. | 208/390 |
| 5,017,281 | A * | 5/1991 | Sadeghi et al. | 208/390 |
| 6,110,359 | A * | 8/2000 | Davis et al. | 208/390 |
| 8,480,859 | B2 * | 7/2013 | Kostrov et al. | 196/14.52 |

* cited by examiner

*Primary Examiner* — Nina Bhat
(74) *Attorney, Agent, or Firm* — David W. Wong

(57) ABSTRACT

Oil sands ore containing bitumen is treated in a reactor chamber by ultrasonic oscillations impact such that cavitation of ore molecules occurs. The disintegration of the pulsating bubbles in the cavitation results in the separation of the oil, water, sand and air fractions of the oil sands. The oil fraction may be continuously extracted for subsequent refining processes.

6 Claims, 2 Drawing Sheets

1
3
4
6
7

OIL SANDS TREATMENT SYSTEM AND PROCESS

This application is a divisional application of U.S. patent application Ser. No. 12/460,759 by the same applicants filed on Jul. 27, 2009, which has issued to U.S. Pat. No. 8,102,615 on Jun. 5, 2012.

BACKGROUND OF THE INVENTION

1. Field of the Invention

This invention relates to a system and process for the treatment of oil sands for the recovery of their petroleum fraction or bitumen.

2. Background Art

Crushed ore of oil sands consisting of bitumen and sand fractions is commonly treated through a water emulsifying process with warm or hot water followed by a vaporization process to extract their bitumen content which is subsequently refined to obtain various petroleum products. Such process is ineffective and costly to carry out due to the demand of a large amount of energy input in the process with a relatively low bitumen output. Chemical material such as sodium hydroxide also has been added into the warm or hot water treatment to increase the amount of bitumen extraction. The water as well as the chemical material discharged from such process are harmful to the natural environment, and the system occupies a large erection site.

A mechanical shearing method has also been employed to de-aerate the slurry of water and oil sands mixture for extracting the bitumen. The slurry is passed through a shearing impeller operated at various high speeds in a treatment tank. In such mechanical shearing process, sand and water settle to the bottom of the tank while the bitumen content is collected in the froth in the top portion of the tank. The process may be repeated in a plurality of tanks to remove further the water and sand contents. However, this method is also ineffective and costly to achieve and the removal process is not uniform and limited and it would rapidly reach a steady saturated level with little increase in the bitumen extraction in the repeated process.

SUMMARY OF THE INVENTION

It is a principal object of the present invention to provide an oil sands treatment process which is effective for separating the bitumen content from the sand of the oil sands ore.

It is an object of the present invention to subject the oil sands ore through highly intensive energy impact to produce cavitation for separating the bitumen content from the sand of the oil sands ore.

It is another object of the present invention to provide high intensity ultrasonic oscillation for creating advanced cavitations in the froth of the mixture of the oil sands ore with water so as to separate the bitumen from the sand.

It is yet another object of the present invention to provide a system which is relatively simple in construction and requires a relatively small site for its erection.

It is yet another object of the present invention to provide a process in which no harmful pollutants are discharged into the natural environment.

It is another object of the present invention to provide a process and system having a significant low power consumption and operating cost with high output efficiency.

The above objects of the present invention are achieved by the formation of cavitation in a pulp mixture of the oil sands ore and water by acoustic impact. The acoustic impact is provided by oscillating ultrasonic band waves which may be produced by means of resonant electromechanical transducers. Cavitation is the phenomenon of the formation of pulsating bubbles in a the oil sands and water mixture. These bubbles are filled with vapor, gas and a mixture of bitumen and other solid matters such as sand. The pulsating bubbles subsequently rupture, and with their disintegration, the vapor, gas, bitumen and the solid matters become separated from one another in ultra dispersion, 5-10 microns, resulting in the extraction of the bitumen from the oil sands. The essential advantage of this method is the relative simplicity in creating cavitation in the oil sands mixture without employing complex mechanical means.

DESCRIPTION OF THE PREFERRED EMBODIMENT

Figure 1:
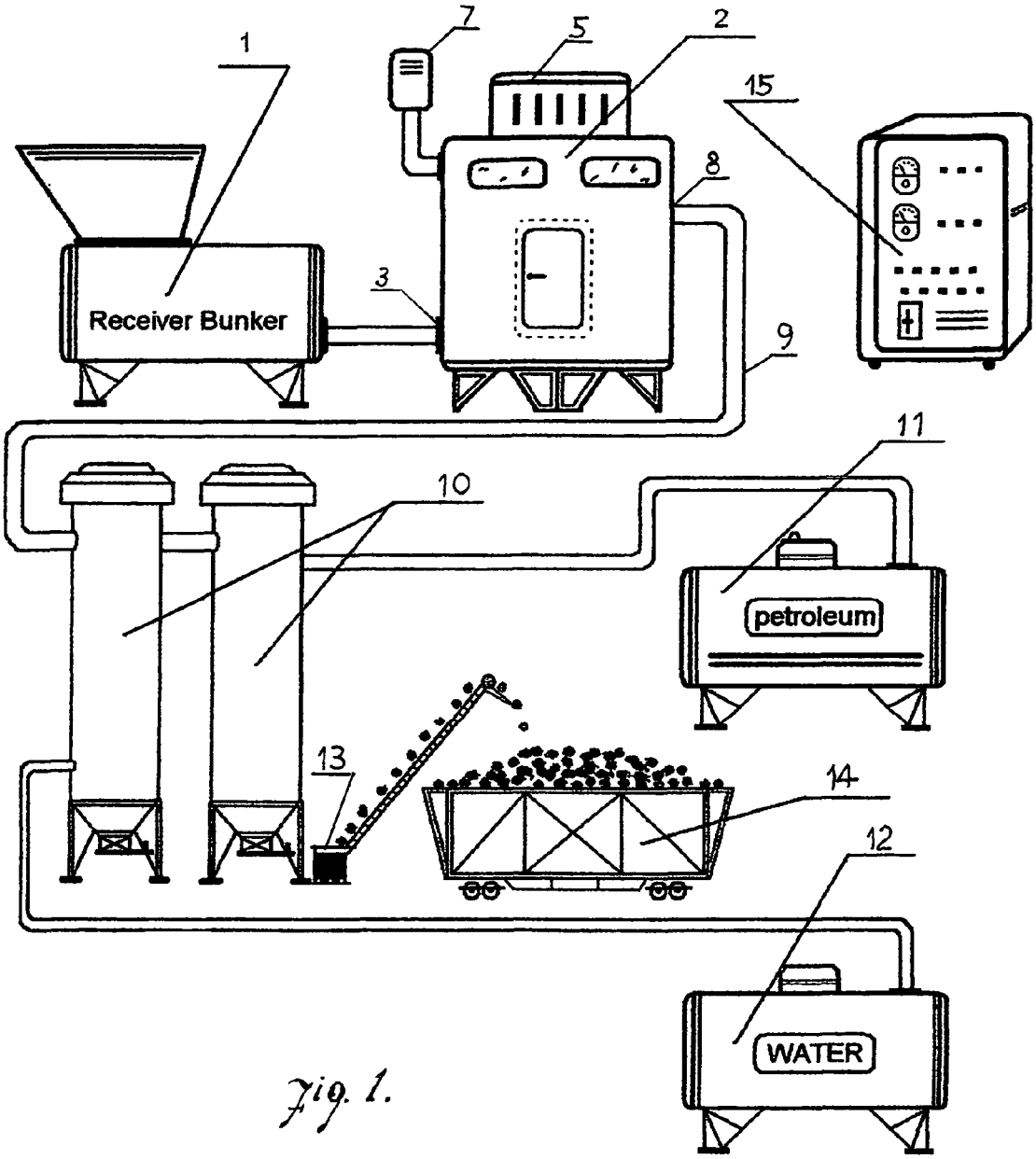
FIG. 1 is a schematic block diagram of the system according to the present invention.
Figures 2, 3, 4:
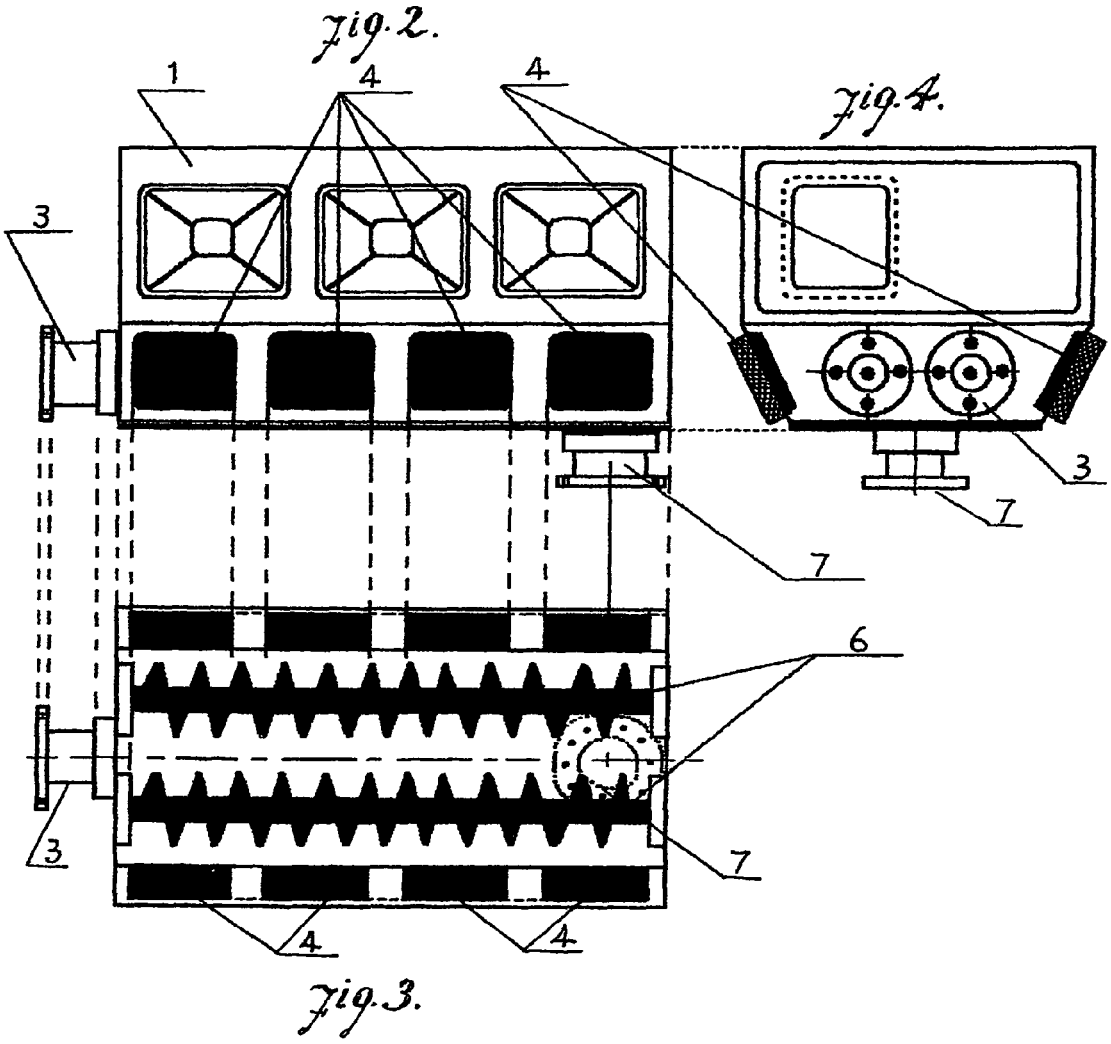
FIG. 2 is an isolated partially cut side elevation view of the ultrasonic transducer section of the reactor of the system of the present invention.
FIG. 3 is a top elevation view of the ultrasonic transducer section of FIG. 2.
FIG. 4 is a sectional isolated side elevation view of the ultrasonic transducer section of FIG. 2.

As best shown in FIG. 1, in the present invention, the oil sands ore is first crushed and deposited into a receiver bunker 1 for mixing with water to form a pulp mixture or sludge which is pumped into a reactor chamber 2 through an inlet port 3. The pulp mixture is sprayed into the reactor chamber 2 by a vortex nozzle so as to provide a uniform distribution and flow of the pulp mixture through the reactor chamber 2. In the mean time, ultrasound wave is generated in the reactor chamber 2 by two rows of transducers 4 by an ultrasound wave generator 5. These transducers may be magnetostrictive tranducers with in-phase excitation of active emitters of ultrasonic oscillations. One row of the transducers 4 produces an ultrasound oscillations of 18-22 KHz, while the other row of transducers 4 produces an ultrasonic oscillations of 5 to 9 KHz. The ultrasonic oscillations create a resonance concentrating zone between the space of the two rows of transducers together with acoustic reflectors (not shown) in the path of the pulp mixture passing through the reactor chamber 2. The resonant ultrasonic oscillations impose an intense impact of an ultrasonic field energy density of more than 40 to 60 $W/cm^2$ on the pulp mixture molecules. Homogeneous exposure of the mixture molecules to the ultrasonic oscillations impact is enhanced by spreading of the molecules between two mechanically operated screw blenders 6. As a result of the intensive ultrasonic oscillations impact onto the bitumen containing pulp mixture molecules, cavitation of the molecules occurs. Through an actual duration of such a process, cavitational bubbles are formed within the viscous, liquid-dispersive medium of solid components, according to cavitational coefficient, under the implosions, which produces a maximum energy impact upon the material. The dimensions of the cavitational bubbles are from hundredth to thousandth of millimeter to few centimeters. High intensity treatment of the oil/sand fractions under the advanced cavitational process is only possible within a relatively thin fluid layer due to rising wave resistance of the gas/vapor mixture zone during such treatment and because of a strong tendency of ultrasonic wave attenuation. A spread zone of ultrasonic oscillations with a high energy component has been in practice limited to a few tens of millimeters. As ultrasonic, acoustic flows propagate within the viscous oil/sand mixture, they are intensely absorbed, which, in turn, imposes limitations onto a work zone of effective treatment in the reactor chamber. In order to expand the treatment work zone and enhance efficiency of the separating processes, it is necessary to utilize a scheme for a flow passage of input product, where the dispersive medium is passed and cycled through the active work zone of the reactor chamber several times. In the process, a peeling action occurs in the imbedded liquid/oil phase micro-clots from grains of sand and various solid admixture as well as occurrence of their physical separation. The oil, water and air fractions of the molecules become separated from the solid fraction, namely sand, of the mixture molecule in the disintegration of the pulsating bubbles in the cavitation process. A high intensity impact of cavitation field can be obtained for the pulp mixture having a viscosity of not exceeding 200-500 $cC_T$. For a pulp mixture having a higher viscosity a preliminary thinning of the mixture may be necessary such as by thermally heating it to 40-70° C. The air fraction of the molecules is discharged from the reactor chamber 2 through an aerator 7 while the cavitated molecules are passed from the outlet port 8 through conducting pipe 9 to a plurality of separation towers 10. Two separation towers 10 are shown in FIG. 1 for simplicity of illustration. The bitumen or oil fraction of the molecule flow from the separation towers 10 to a collection tank 11 for subsequent refining process into various petroleum products. The water and sand fall to the bottom portion of the separating towers 10 from which the water is retrieved to a water tank 12 while the sand and other solid fraction are discharged from the bottom of the separation towers 10 to a conveyor device 13 to be collected in a bin 14 for disposal.

The operation of the process of the present invention may be controlled by a central control unit 15.

The simplicity of the system of the present invention offers significant savings in power consumption and the reduction of cost of the bitumen recovery process, yet it produces no harmful pollutants into the natural environment. The water content may be recycled into the process. A high quality bitumen may be continuously produced for subsequent refining process. The system may also be erected in a relatively small site.

Various modifications can be made without departing from the spirit of this invention or the scope of the appended claims. The embodiment of the invention set forth in this disclosure are given as examples and are in no way final or binding. In view of the above, it will be seen that several objects of the invention are achieved and other advantages are obtained. As many changes could be made in the above system and method without departing from the scope of the invention, it is intended that all matter contained in the above description shall be interpreted as illustrative and not in a limiting sense.

What is claimed is:

1. A system of treatment of oil sands ore comprising, a receiver bunker operative for mixing said oil sands ore in a crushed state with a predetermined amount of water to form a pulp mixture, a reactor chamber having an inlet port connected to said receiver bunker, a vortex jet located at said inlet port and operative to inject said pulp mixture in a spray form into an active zone in said reactor chamber, ultrasonic oscillations transducers located in said active zone in said reactor chamber, said ultrasonic oscillations transducers emitting two ultrasonic oscillation frequencies interfering with one another to produce intense concentrated resonant ultrasonic oscillations to impact on molecules of said spray form of pulp mixture in said active zone for causing cavitation to occur in said molecules of said pulp mixture in said spray form for separating oil, water and sand fractions of said pulp mixture, a separation tower connected to said reactor chamber and operative for separating oil fraction of said pulp mixture after having subjected to cavitation in said reactor chamber.

2. A system of treatment of oil sands according to claim 1 including mechanically operative blenders located in said reactor chamber, said blenders being operative for passing said pulp mixture a plurality of times repeatedly through said active zone of said reactor chamber.

3. A system of treatment of oil sands ore according to claim 2 wherein said resonant ultrasonic oscillations impose an intense impact of an ultrasonic field energy density of more than 40 to 60 $W/cm^2$ on said pulp mixture.

4. A system of treatment of oil sands according to claim 3 including a collection tank connected to said separation tower and operative for receiving said oil fraction from said separation tower for subsequent refining process.

5. A system of treatment of oil sands according to claim 4 including a water tank connected to a lower portion of said separation tower and operative for receiving a water fraction from said pulp mixture in said separation tower.

6. A system of treatment of oil sands according to claim 5 including a conveyor connected to a bottom part of said separation tower and operative for receiving and conveying sand and solid fractions of said pulp mixture from said separation tower.

* * * * *